US006487724B1

(12) United States Patent
Aoki

(10) Patent No.: US 6,487,724 B1
(45) Date of Patent: Dec. 3, 2002

(54) BALL-CATCHING PIECE

(75) Inventor: Akio Aoki, Hirakata (JP)

(73) Assignee: Trion Corporation, Osaka (JP)

( * ) Notice: Subject to any disclaimer, the term of this patent is extended or adjusted under 35 U.S.C. 154(b) by 0 days.

(21) Appl. No.: 10/053,519

(22) Filed: Nov. 9, 2001

(51) Int. Cl.[7] ..... A41D 13/08
(52) U.S. Cl. ..... 2/19
(58) Field of Search ..... 2/16, 19, 20, 159, 2/161.1, 161.6, 163; 473/205

(56) References Cited

U.S. PATENT DOCUMENTS

| | | | | | |
|---|---|---|---|---|---|
| 2,778,023 | A | * | 1/1957 | Tompkins | 2/19 |
| 4,651,345 | A | | 3/1987 | Latina | |
| 4,665,561 | A | * | 5/1987 | Aoki | 2/16 |
| 4,853,975 | A | | 8/1989 | Clevenhagen | |
| 5,659,897 | A | * | 8/1997 | Satoh et al. | 2/16 |
| 6,199,209 | B1 | | 3/2001 | Aoki | |

* cited by examiner

*Primary Examiner*—Gary Welch
(74) *Attorney, Agent, or Firm*—Fulbright & Jaworski L.L.P.

(57) ABSTRACT

A ball-catching piece comprises a main body of the above-mentioned ball-catching piece, a thumb-supporting piece provided in a thumb stall in the above-mentioned main body of the above-mentioned ball-catching piece to allow the position of a thumb to be fixed and to allow a fixed position of the above-mentioned thumb to be free, and a band provided in the above-mentioned main body of the above-mentioned ball-catching piece to allow a push to be exerted on a hand and to allow the push to be eliminated in the hand-width direction along which the backside of the above-mentioned hand is received and supported. The above-mentioned thumb-supporting piece comprises a first strap with which the above-mentioned thumb can be pushed from the side of the first finger and a second strap with which the above-mentioned thumb can be pushed from a side opposing the side of the above-mentioned first finger; the above-mentioned second strap is inserted through a first through-hole formed in outer leather of the above-mentioned main body of the above-mentioned ball-catching piece and is then inserted through a second through-hole formed in the above-mentioned band; and the second strap is used to enable the above-mentioned band to push the above-mentioned hand.

4 Claims, 4 Drawing Sheets

BALL-CATCHING PIECE

BACKGROUND OF THE INVENTION

1. Field of the Invention

The present invention relates to a ball-catching piece, particularly, such as a glove used to play, for example, baseball and softball.

2. Description of the Related Art

A ball-catching piece includes a thumb-supporting piece to enable the ball-catching piece to fit with the hand. A conventional thumb-supporting piece is merely formed of a strap with which a push is exerted on the thumb from the side of a first finger, hence allowing a portion of a thumb on the side opposing a first finger to be in push-contact with inner leather of a main body of the ball-catching piece.

According to the above construction of the conventional ball-catching piece, the thumb is merely pushed from the side of the first finger. As such, positional-fixing for the thumb is insufficient, therefore making it difficult to well fit with the ball-catching piece to the hand.

SUMMARY OF THE INVENTION

The present invention is made in view of the above-described circumstances. An object of the present invention is to provide a ball-catching piece that well fits with the hand.

According to a feature in the configuration of a ball-catching piece of the present invention, a thumb-supporting piece is provided in a thumb stall in a main body of the ball-catching piece to allow the position of a thumb to be fixed and to allow a fixed position of the above-mentioned thumb to be free, and a band is provided in the above-mentioned main body of the above-mentioned ball-catching piece to allow a push to be exerted on a hand and to allow the push to be eliminated in the hand-width direction along which the backside of the above-mentioned hand is received and supported.

The above-mentioned thumb-supporting piece is formed to include a first strap with which the above-mentioned thumb can be pushed from the side of a first finger and a second strap with which the above-mentioned thumb can be pushed from a side opposing the side of the above-mentioned first finger; the above-mentioned second strap is inserted through a first through-hole formed in outer leather of the above-mentioned main body of the above-mentioned ball-catching piece and is then inserted through a second through-hole formed in the above-mentioned band; and the second strap is used to enable the above-mentioned band to push the above-mentioned hand.

According to the configuration, the following operations and advantages can be produced.

The first strap is used to push a thumb from the side of the first finger, and the second strap is used to push the thumb from the side opposing the side of the first finger. The second strap is inserted through the first through-hole formed in the outer leather of the main bode of the ball-catching piece, and is then inserted through the second through-hole formed in the band. The second strap thus formed is used to push the band to the hand.

In this way, the thumb is pushed not only from the side of the first finger, but also from a side opposing the side of the first finger. This enables the position of the thumb to be stably fixed onto the main body of the ball-catching piece.

Furthermore, since the second strap is used to push the band to the hand, a portion of the hand on a wrist side can be stably fixed onto the ball-catching piece.

For example, in a configuration in which a band-dedicated position-fixing member that is different from the above-mentioned second strap is pushed to the hand, an increased number of components need to be used, and the configuration is therefore complicated.

According to the configuration of the present invention, however, since the second strap for pushing the thumb is used to push the band to the hand, the number of components can be reduced. Thereby, the configuration can be simplified, and concurrently, the push operation can be easily implemented.

Still furthermore, a single second strap is used to simultaneously fix the positions of the thumb and the portion of the hand in the wrist side. This enables the motion of the thumb to be more difficult with respect to a portion of the hand in the wrist side in comparison to a case in which two members are used to fix the positions independently of each other.

As a result, the present invention can provide the ball-catching piece that well fits with the hand.

According to another feature of in the configuration of a ball-catching piece of the present invention, a thumb-supporting piece is provided in a thumb stall in a main body of the ball-catching piece to allow the position of a thumb to be fixed and to allow a fixed position of the above-mentioned thumb to be free; and outer leather on a backside of the above-mentioned main body of the above-mentioned ball-catching piece, wherein the above-mentioned outer leather is formed in a such a manner as to cover a backside of a hand to allow a push to be exerted on a hand-insertion-opening-side outer leather portion for receiving and supporting a wrist side of the backside of the above-mentioned hand so as to push the above-mentioned hand, and to allow the push to be eliminated.

The above-mentioned thumb-supporting piece is formed to include a first strap with which the above-mentioned thumb can be pushed from the side of the first finger and a second strap with which the above-mentioned thumb can be pushed from a side opposing the side of the above-mentioned first finger; the above-mentioned second strap is inserted through a first through-hole formed in outer leather of the above-mentioned main body of the above-mentioned ball-catching piece and is then inserted through a second through-hole formed in the above-mentioned hand-insertion-opening-side outer leather portion; and the second strap is used to enable the above-mentioned hand-insertion-opening-side outer leather portion to push the above-mentioned hand.

According to the above configuration, the following operations and advantages can be produced.

The first strap is used to push a thumb from the side of a first finger, and the second strap is used to push the thumb from the side opposing the side of the first finger. The second strap is inserted through the first through-hole formed in the outer leather of the main bode of the ball-catching piece, and is then inserted through the second through-hole formed in the band. The second strap thus formed is used to push the band to the hand.

In this way, the thumb is pushed not only from the side of the first finger, but also from a side opposing the side of the first finger. This enables the position of the thumb to be stably fixed onto the main body of the ball-catching piece.

Furthermore, since the second strap is used to push the band to the hand, a portion of the hand on a wrist side can be stably fixed onto the ball-catching piece.

For example, in a configuration in which a position-fixing member that is dedicated for a hand-insertion-opening-side outer leather portion, which is different from the above-mentioned second strap, is pushed to the hand, an increased number of components need to be used. Thereby, the configuration is complicated.

According to the configuration of the present invention, however, since the second strap for pushing the thumb is used to push the hand-insertion-opening-side outer leather portion to the hand, the number of components can be reduced. Thereby, the configuration can be simplified, and concurrently, the push operation can be easily implemented.

Still furthermore, a single second strap is used to simultaneously fix the positions of the thumb and the portion of the hand on the wrist side. This enables the motion of the thumb to be more difficult with respect to a portion of the hand in the wrist side in comparison to a case in which two members are used to fix the positions independently of each other.

As a result, the present invention can provide the ball-catching piece that well fits with the hand.

Preferably, the configuration is built such that the above-mentioned first strap is inserted through a third through-hole formed on a side of a base-end portion of the above-mentioned outer leather of the above-mentioned thumb stall, and a portion of the above-mentioned first strap is tied in the outside of the above-mentioned outer leather not to come out of the above-mentioned third through-hole, thereby causing the above-mentioned thumb to be pushed;

and a portion of the above-mentioned second strap that has been inserted through the above-mentioned second through-hole is connectable to a side of a base-end portion of the above-mentioned outer leather of the above-mentioned thumb stall via a hook-and-loose fastener.

According to the above configuration, the following operations and advantages can be produced.

The above-mentioned first strap is inserted through the third through-hole formed on a side of a base-end portion of the above-mentioned outer leather of the above-mentioned thumb stall, and a portion of the above-mentioned first strap is tied in the outside of the above-mentioned outer leather not to come out of the above-mentioned third through-hole, thereby causing the above-mentioned thumb to be pushed.

In addition, a portion of the above-mentioned second strap that has been inserted through the above-mentioned second through-hole formed in a portion of the band (or, a portion of the hand-insertion-opening-side outer leather portion) on the side of the thumb stall is connected to a side of a base-end portion of the outer leather of the thumb stall via a hook-and-loose fastener to thereby push the hand.

Consequently, the present invention can provide the ball-catching piece that well fits with the hand.

DETAILED DESCRIPTION OF THE PREFERRED EMBODIMENTS

Hereinbelow, embodiments of the present invention will be described in detail with reference to the accompanying drawings.

The First Embodiment of the Invention

Figure 1:
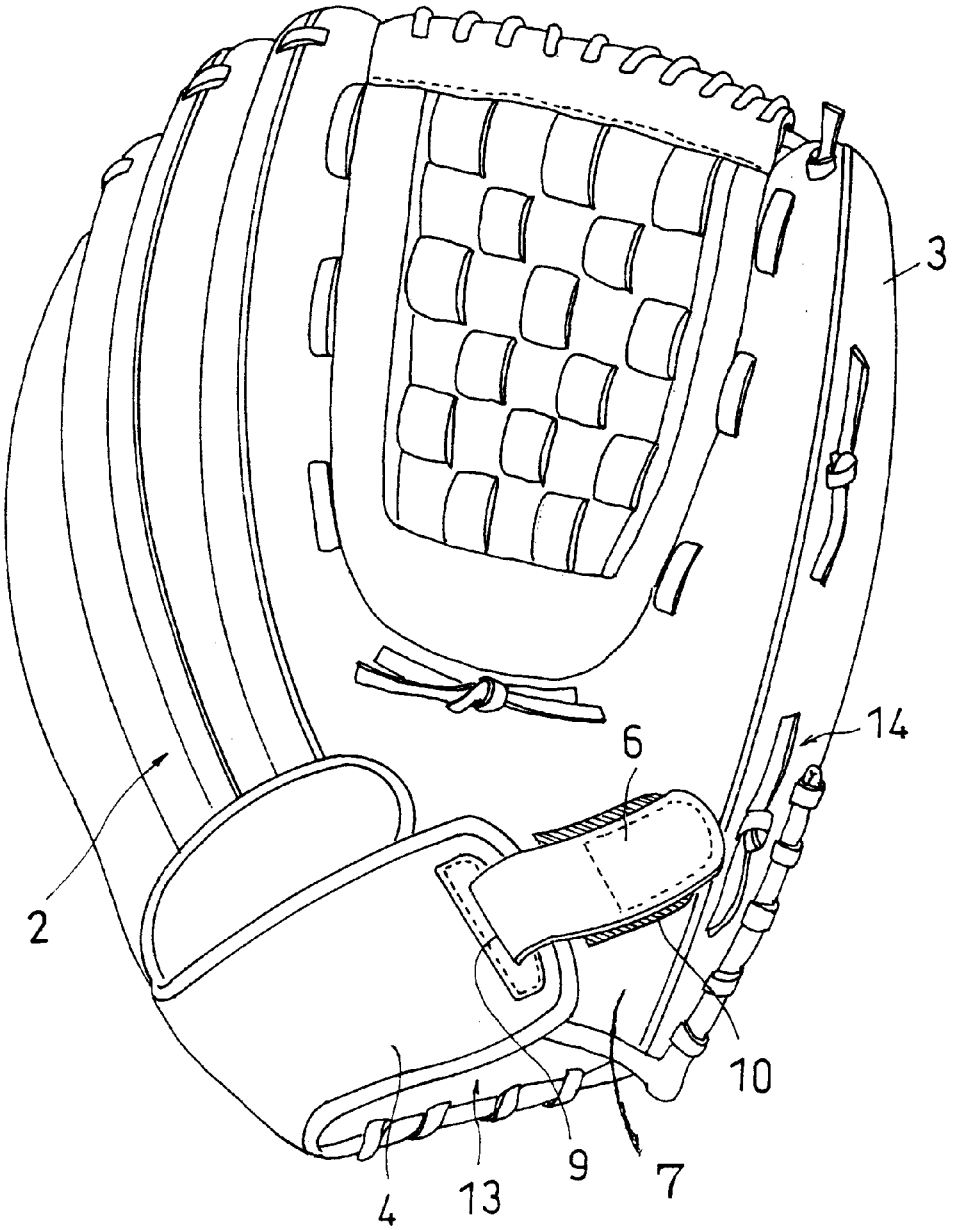
FIG. 1 is a perspective view of an opening-type glove according to an embodiment of the present invention.
Figure 2:
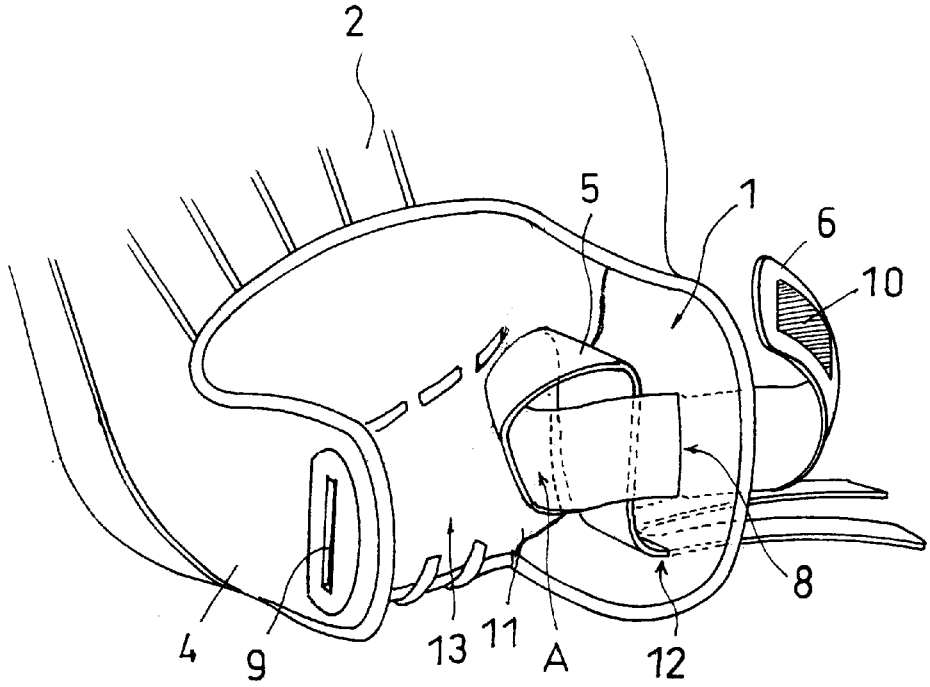
FIG. 2 shows a thumb-supporting piece of the glove shown in FIG. 1.

FIGS. 1 and 2 each show a baseball glove of an opening type as a ball-catching piece. The glove includes a thumb-supporting piece 1 in a base-end portion of a thumb stall 3 of a glove main body 2 (corresponding to a ball-catching-piece main body). The thumb-supporting piece 1 is provided to allow the position of a thumb to be fixed and to allow a fixed position of the thumb to be unfixed. In addition, a band 4 extending in the hand-width direction is formed for receiving and supporting the backside of a hand is provided in the glove main body 2 to exert a push on the hand and to relieve the push. Reference numeral 13 denotes a hand-inserting opening.

The thumb-supporting piece 1 is formed by stitching a longitudinally-central portion A of a strap together with inner leather 11 (See FIG. 2). First and second strap 5 and 6 are formed on two sides of the strap in such a manner as to sandwich the stitched portion. The first strap 5 is formed on one of the sides to allow the thumb to be pushed from the side of a first finger. The second strap 6 is formed on the other side to allow the thumb to be pushed from the side opposing the side of the first finger.

Thus, the thumb-supporting piece 1 includes the first strap 5 and the second strap 6. The first strip 5 is formed to allow the thumb to be pushed from the side of the first finger, whereas the second strap 6 is formed to allow the thumb to be pushed from the side opposing the first finger.

More specifically, the first strap 5 is formed as follows. The first strap 5 is inserted through a third through-hole 12 formed on the side of a base-end portion of outer leather 7 of the thumb stall 3. Then, a portion of the first strap 5 (the portion is separated into two portions) is tied with a knot in the outside of the outer leather 7 not to come out of the third through-hole 12. In this way, the first strap 5 is formed to push the thumb. In FIG. 1, reference numeral 14 denotes the knot.

Figure 3:
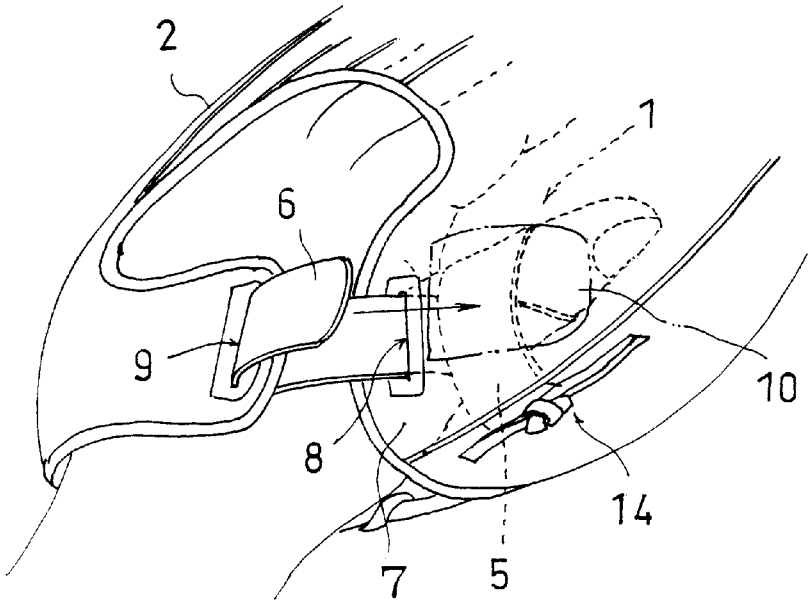
FIG. 3 shows a state in which the position of a thumb is fixed using the thumb-supporting piece of the glove shown in FIG. 1.

The second strap 6 is formed as follows. As shown in FIG. 3, the second strap 6 is inserted through a first through-hole 8 formed in the above-mentioned outer leather 7, and is further inserted through a second through-hole 9 formed in the band 4. Then, a portion of the second strap 6 that has been inserted through the second through-hole 9 is connected via a hook-and-loose fastener 10 to a base-end portion of the outer leather 7 in the thumb stall 3. In this way, the second strap 6 is formed to push the band 4 onto the hand.

In the construction as described above, the thumb is pushed by the first strap 5 from the side of the first finger, and is pushed by the second strap 6 from the side opposing the first finger. In addition, the second strap 6 inserted through the first through-hole 8 formed in the outer leather 7 of the glove main body 2 is inserted through the second through-hole 9. Hence, the second strap 6 works to push the band 4 onto the hand.

As described above, since the thumb is pushed by not only the first finger side, but also the side opposing the first finger, the thumb can be stably fitted with the glove main body 2.

Furthermore, since the second strap 6 is used to push the band 4 onto the hand, a portion of the hand on the wrist side can be stably fitted with the glove main body 2.

The Second Embodiment of the Invention

Figure 4:
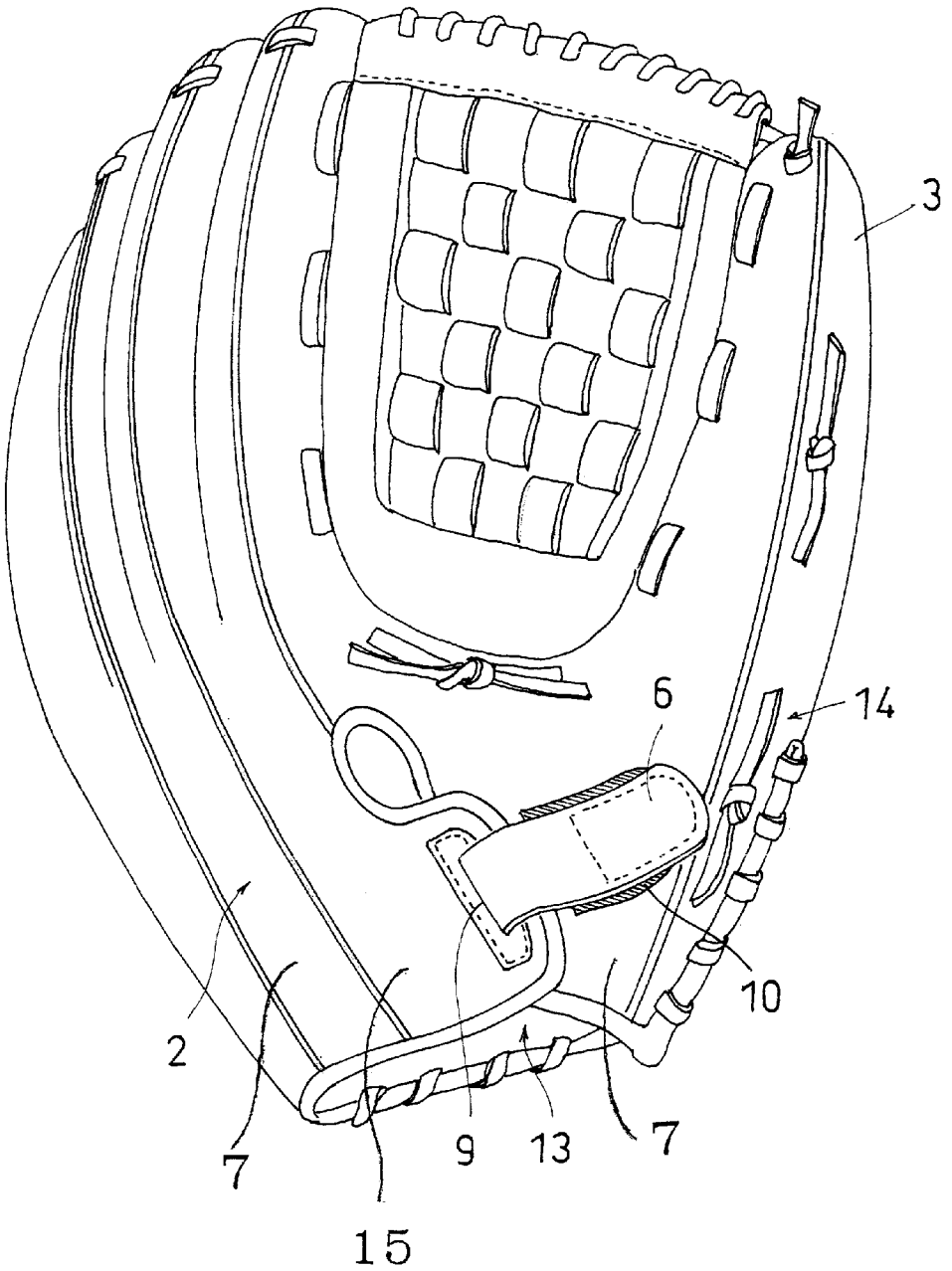
FIG. 4 is a perspective view a totally-closed-type glove according to another embodiment of the present invention.
Figure 5:
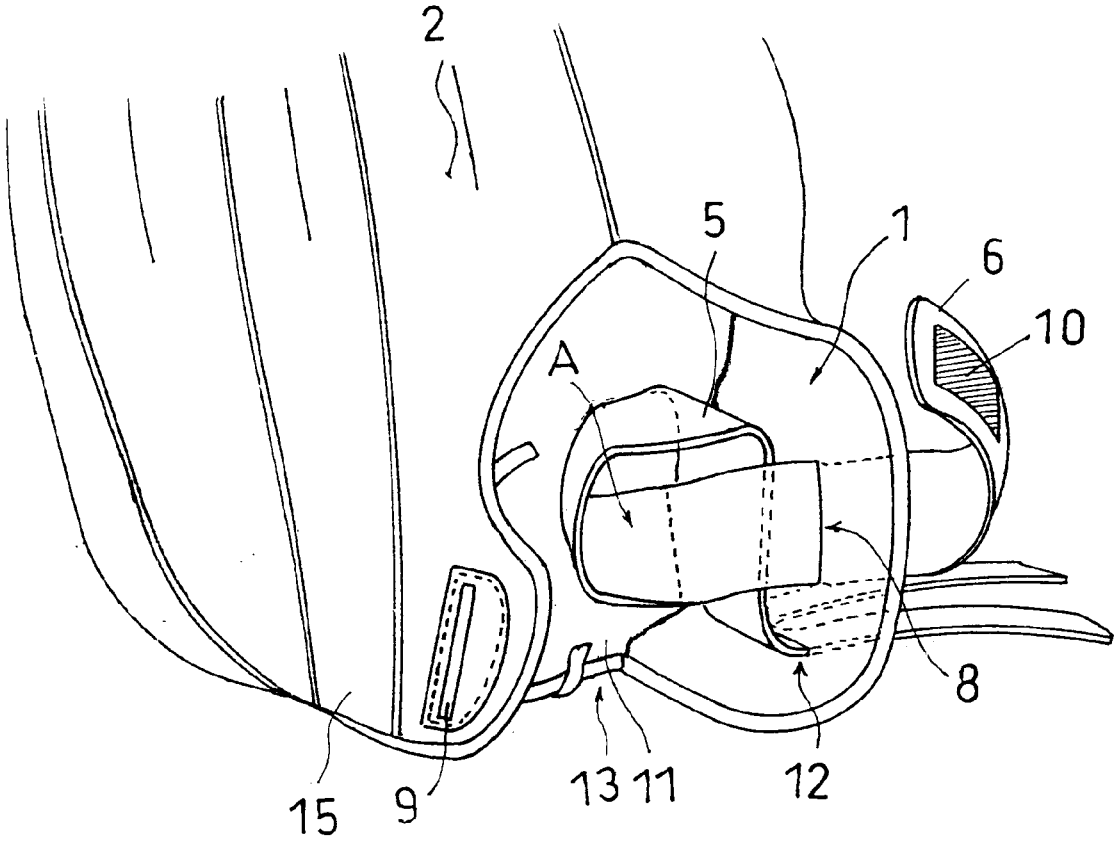
FIG. 5 shows a thumb-supporting piece of the glove shown in FIG. 4.

FIGS. 4 and 5 show a baseball glove of a totally-closed type as a ball-catching piece. The glove includes a thumb-supporting piece 1 a thumb stall 3 of a glove main body 2. The thumb-supporting piece 1 is provided to allow the position of the thumb to be fixed and to allow a fixed position of the thumb to be unfixed. In addition, outer leather 7 on a backside of the glove main body 2 is formed in such a manner as to cover the backside of the hand. Furthermore, a hand-insertion-opening-side outer leather portion 15 is formed for receiving and supporting the backside of the hand on the wrist side to allow a push to be exerted on the hand and to allow the push to be eliminated.

The construction of a thumb-supporting piece 1 is substantially the same as that of the thumb-supporting piece 1 of the first embodiment. Hereinbelow, differences from the first embodiment will be described. The second strap 6 described above is inserted through the first through-hole 8 formed in the outer leather 7, and is further inserted through a second through-hole 9 formed in the hand-insertion-opening-side outer leather portion 15. Then, the portion of the second strap 6 that has been inserted through the second through-hole 9 is connected via the hook-and-loose fastener 10 to a base-end portion of the outer leather 7 in the thumb stall 3. In this way, the second strap 6 is formed to push the hand-insertion-opening-side outer leather portion 15 onto the hand.

Also the construction as described above enables the provision of the same advantages as those that can be obtained from the construction of the first embodiment.

The Another Embodiment of the Invention

The portion of the second strap 6, which was inserted into the above-described second through-hole 9, may be connected to the base-end portion of the outer leather 7 of the thumb stall 3 via a connecting means that is different from the hook-and-loose fastener 10.

The present invention is also applicable to, for example, a catcher mitt and a first-base-player mitt used for baseball. Furthermore, the present invention is applicable to, for example, a glove, a catcher mitt and a first-base-player mitt used for softball.

What is claimed is:

1. A ball-catching piece comprising:

a main body of said ball-catching piece;

a thumb-supporting piece provided in a thumb stall in said main body of said ball-catching piece to allow the position of a thumb to be fixed and to allow a fixed position of said thumb to be free; and a band provided in said main body of said ball-catching piece to allow a push to be exerted on a hand by a second strap and to allow the push to be eliminated by the second strap in the hand-width direction along which the backside of said hand is received and supported, wherein said thumb-supporting piece comprises a first strap with which said thumb can be pushed from the side of the first finger and a second strap with which said thumb can be pushed from a side opposing the side of said first finger;

said second strap is inserted through a first through-hole formed in outer leather of said main body of said ball-catching piece and is then inserted through a second through-hole formed in said band; and said second strap is used to enable said band to push said hand; and wherein said first strap is inserted through a third though-hole formed on a side of a base-end portion of said outer leather of said thumb stall, and a portion of said first strap is tied in the outside of said outer leather not to come out of said third through-hole, thereby causing said thumb to be pushed; and a portion of said second strap that has been inserted through said second through-hole is connectable to a side of a base-end portion of said outer leather of said thumb stall via a hook-and-loop fastener.

2. The ball-catching piece according to claim 1, wherein the end of the portion of said first strap is separated in two portions so as to be tied in the outside of said outer leather.

3. A ball-catching piece comprising:

a main body of said ball-catching piece;

a thumb-supporting piece provided in a thumb stall in said main body of said ball-catching piece to allow the position of a thumb to be fixed and to allow a fixed position of said thumb to be free; and outer leather on a backside of said main body of said ball-catching piece, wherein said outer leather is formed in a such a manner as to cover a backside of a hand to allow a push to be exerted on a hand-insertion-opening-side outer leather portion for receiving and supporting a wrist side of the backside of said hand so as to push said hand by a second strap, and to allow the push to be eliminated by the second strap, wherein said thumb-supporting piece comprises a first strap with which said thumb can be pushed from the side of the first finger and a second strap with which said thumb can be pushed from a side opposing the side of said first finger;

said second strap is inserted through a first through-hole formed in outer leather of said main body of said ball-catching piece and is then inserted through a second through-hole formed in said hand-insertion-opening-side outer leather portion; and said second strap is used to enable said hand-insertion-opening-side outer leather portion to push said hand; and wherein said first strap is inserted through a third through-hole formed on a side of a base-end portion of said outer leather of said thumb stall, and a portion of said first strap is tied in the outside of said outer leather not to come out of said third though-hole, thereby causing said thumb to be pushed; and a portion of said second strap that has been inserted through said second through-hole is connectable to a side of a base-end portion of said outer leather of said thumb stall via a hook-and-loop fastener.

4. The ball-catching piece according to claim 3, wherein the end of the portion of said first strap is separated in two portions so as to be tied in the outside of said outer leather.

* * * * *